US008618455B2

(12) United States Patent
Hultman

(10) Patent No.: US 8,618,455 B2
(45) Date of Patent: Dec. 31, 2013

(54) ADJUSTABLE RANGE MUNITION

(75) Inventor: John A. Hultman, Casper, WY (US)

(73) Assignee: Safariland, LLC, Jacksonville, FL (US)

( * ) Notice: Subject to any disclaimer, the term of this patent is extended or adjusted under 35 U.S.C. 154(b) by 490 days.

(21) Appl. No.: 12/788,816

(22) Filed: May 27, 2010

(65) Prior Publication Data

US 2012/0175456 A1 Jul. 12, 2012

Related U.S. Application Data

(60) Provisional application No. 61/184,436, filed on Jun. 5, 2009.

(51) Int. Cl.
*F42B 10/32* (2006.01)
*F42B 10/00* (2006.01)

(52) U.S. Cl.
USPC ..... 244/3.22; 244/3.1; 244/3.15; 244/3.21

(58) Field of Classification Search
USPC ..... 89/1.11; 244/3.1–3.22; 102/382–384, 102/430, 501, 473, 502; 124/80, 41.1–44.7, 124/56, 57, 63–70
See application file for complete search history.

(56) References Cited

U.S. PATENT DOCUMENTS 2,995,894 A * 8/1961 Baxter et al. ..... 244/3.22
3,046,966 A * 7/1962 Butler et al. ..... 124/70
3,115,887 A * 12/1963 McCorkle ..... 244/3.22
3,142,959 A * 8/1964 Klein ..... 244/3.22
3,374,967 A * 3/1968 Plumley ..... 244/3.14
3,599,899 A * 8/1971 McCullough ..... 244/3.22
3,612,442 A * 10/1971 Chisel ..... 244/3.22
3,739,764 A * 6/1973 Allport ..... 124/70
3,749,334 A * 7/1973 McCorkle, Jr. ..... 244/3.22
3,802,190 A * 4/1974 Kaufmann ..... 244/3.22
3,843,076 A * 10/1974 King et al. ..... 244/3.16
3,889,652 A * 6/1975 Curtis ..... 124/41.1
3,926,390 A * 12/1975 Teuber et al. ..... 244/3.22
3,977,629 A * 8/1976 Tubeuf ..... 244/3.22
3,977,633 A * 8/1976 Keigler et al. ..... 244/3.22
3,979,085 A * 9/1976 Leonard ..... 244/3.15
4,211,378 A * 7/1980 Crepin ..... 244/3.22
4,408,735 A * 10/1983 Metz ..... 244/3.22
4,413,795 A * 11/1983 Ryan ..... 244/3.22
4,428,293 A * 1/1984 Botwin et al. ..... 244/3.21
4,444,114 A * 4/1984 Bisping et al. ..... 102/430
4,463,921 A * 8/1984 Metz ..... 244/3.22
4,482,107 A * 11/1984 Metz ..... 244/3.22
4,492,166 A * 1/1985 Purcell ..... 102/384
4,502,649 A * 3/1985 Botwin et al. ..... 244/3.1
4,568,040 A * 2/1986 Metz ..... 244/3.22
4,712,748 A * 12/1987 Schafer ..... 244/3.22
4,726,544 A * 2/1988 Unterstein ..... 244/3.22
4,856,734 A * 8/1989 Davies ..... 244/3.22
4,967,982 A * 11/1990 Bagley ..... 244/3.22
4,979,697 A * 12/1990 Kranz ..... 244/3.22
5,054,712 A * 10/1991 Bar et al. ..... 244/3.22
5,062,593 A * 11/1991 Goddard et al. ..... 244/3.22
5,112,007 A * 5/1992 Buchele-Buecher ..... 244/3.22
5,238,204 A * 8/1993 Metz ..... 244/3.15

(Continued)

*Primary Examiner* — Bernarr Gregory
(74) *Attorney, Agent, or Firm* — Kane Kessler, P.C.; Paul E. Szabo

(57) ABSTRACT

An adjustable range munition has at least one gas vent that is selectively variable to affect the amount of force that is directed onto the projectile upon actuation of the propellant section, thereby to control the range of the munition.

16 Claims, 4 Drawing Sheets

(56) References Cited

U.S. PATENT DOCUMENTS

| | | | | | |
|---|---|---|---|---|---|
| 5,456,425 | A * | 10/1995 | Morris et al. | ..... | 244/3.22 |
| 5,456,429 | A * | 10/1995 | Mayersak | ..... | 244/3.22 |
| 5,839,940 | A * | 11/1998 | Ensmenger | ..... | 124/57 |
| 6,138,945 | A * | 10/2000 | Biggers et al. | ..... | 244/3.22 |
| 6,178,741 | B1 * | 1/2001 | Nelson et al. | ..... | 244/3.22 |
| 6,231,003 | B1 * | 5/2001 | Hibma et al. | ..... | 244/3.22 |
| 6,267,326 | B1 * | 7/2001 | Smith et al. | ..... | 244/3.22 |
| 6,367,735 | B1 * | 4/2002 | Folsom et al. | ..... | 244/3.22 |
| 6,629,668 | B1 * | 10/2003 | Grau et al. | ..... | 244/3.22 |
| 6,817,569 | B1 * | 11/2004 | Horwath | ..... | 244/3.17 |
| 7,004,423 | B2 * | 2/2006 | Folsom et al. | ..... | 244/3.22 |
| 7,416,154 | B2 * | 8/2008 | Bittle et al. | ..... | 244/3.22 |
| 7,741,588 | B2 * | 6/2010 | Gundel et al. | ..... | 244/3.15 |
| 7,891,298 | B2 * | 2/2011 | Minick et al. | ..... | 102/501 |

* cited by examiner

ADJUSTABLE RANGE MUNITION

BACKGROUND OF THE INVENTION

The present invention relates to the field of less lethal impact munitions. In particular, the invention relates to an adjustable range impact munition which can be deployed at a selected one of a plurality of different engagement distances (ranges).

Less lethal impact munitions are used to redirect, control, or incapacitate subjects (people), or to mark. Impact munitions can deliver blunt force effects, a marking/irritant composition, or a combination of both payloads. Impact munitions can be designed for use with individual or multiple targets. They may be designed to be skip fired in front of or adjacent to the target, or to be aimed directly at the target's center of mass.

Each particular round of impact munition is designed and constructed for use at a specific operational range. The range is selected to provide maximum effect without compromising target safety. This operational range is built specifically into each round, by varying the amount of propellant in the round or by altering the containment or shell base configuration. This process allows manufacturers of impact munitions the ability to offer the same type of round in multiple operational distances.

While providing similar rounds with different ranges broadens the overall product capability, it forces an end user either to carry multiple rounds, or to carry a single round that may be either ineffective or unsafe because it may be used at an unintended range. Either scenario is undesirable.

BRIEF DESCRIPTION OF THE DRAWINGS

Features of the invention will become clear from a reading of the following description of embodiments of the invention, together with the accompanying drawings, in which.

DETAILED DESCRIPTION OF EMBODIMENTS OF THE INVENTION

Figure 1:
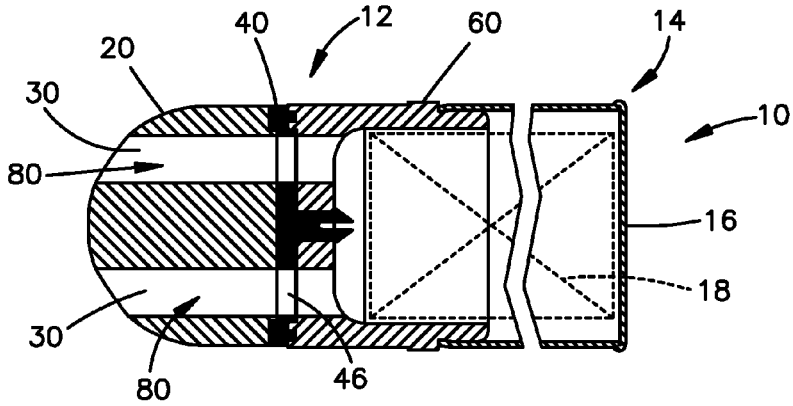
FIG. 1 is a longitudinal sectional view of a munition that is a first embodiment of the invention, including a projectile having axial vents and a shell that is shown partially broken away.
Figure 2:
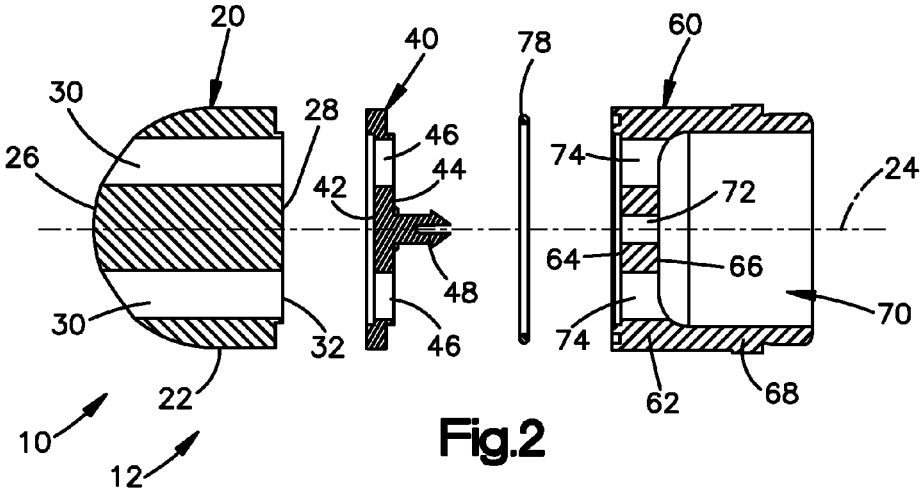
FIG. 2 is an exploded longitudinal sectional view of the projectile of FIG. 1.
Figure 3:
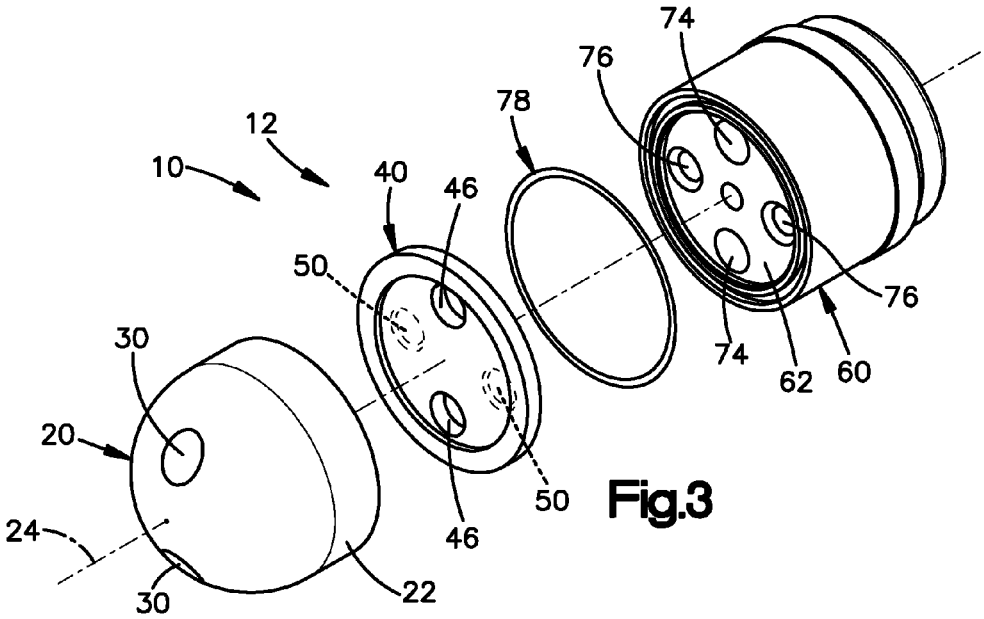
FIG. 3 is an exploded perspective view of the projectile of FIG. 1.

The present invention relates to the field of less lethal impact munitions. In particular, the invention relates to an adjustable range impact munition, that is, a munition which can be deployed at a selected one of a plurality of different engagement distances (ranges). The invention is applicable to munitions of varying and different constructions. As representative of the invention, FIGS. 1-7 illustrate an adjustable range munition or cartridge 10 that is a first embodiment of the invention.

The cartridge 10 includes a projectile 12 and a propellant unit shown schematically at 14. The propellant unit 14 includes a shell 16 and a propellant or charge 18. The propellant unit 14 is actuatable to produce gas under pressure that pushes on the projectile 12 (in a direction to the left as viewed in FIG. 1) thereby to release the projectile from the shell and cause it to travel to a target. The configuration and composition of the propellant unit 14 do not form part of this invention and, therefore, are not described in further detail.

The projectile 12 includes a nose 20, a diverter ring 40, a body 60, and a seal 78. The projectile nose 20 may take any one of many different configurations depending on the intended use of the cartridge. In the illustrated embodiment, the nose 20 is a solid piece made from a compliant or a frangible material.

The nose 20 has a generally dome-shaped configuration including a cylindrical outer side surface 22 centered on a longitudinal central axis 24 of the projectile 12, capped by a dome-shaped front end surface 26. The nose 20 has a generally planar rear surface 28 that is presented toward the projectile body 60 and the shell 16.

In the illustrated embodiment, the nose 20 has two cylindrical passages 30 extending axially between the nose rear surface 28 and the nose front end surface 26. The passages 30 terminate in diametrically opposite circular openings 32 in the nose rear surface 28.

The diverter ring 40 is a disc-shaped element that has circular front and rear major side surfaces 42 and 44. The diverter ring has two cylindrical passages 46 extending axially through the ring between the front and rear side surfaces 42 and 44. The passages 46 are diametrically opposite each other. The diverter ring 40 has a locking pin 48 that projects rearward from the rear side surface 44.

The diverter ring 40 also has two indexing bosses 50 that project axially from the rear surface 44 of the ring. The bosses 50 are diametrically opposite each other, and are located angularly between the two passages 46 in the ring 40. Thus, the two bosses 50 and the two passages 46 are located at ninety degree intervals around the axis 24.

The projectile body 60 has a generally cylindrical configuration including a radially extending front end wall 62 with front and rear major side surfaces 64 and 66, and a cylindrical side wall 68. The side wall 68 and the end wall 62 define a pressure chamber 70 in the body 60. The front of the pressure chamber 70 is defined by the rear side surface 66 of the end wall 62. The rear of the pressure chamber 70 is open, to receive gas under pressure from the propellant unit 14.

The end wall 62 of the projectile body 60 has a locking pin opening 72 for receiving the locking pin 48 of the diverter ring 40. The end wall 62 also has two cylindrical passages 74 extending axially between the front and rear major side surfaces 64 and 66. The passages 74 are diametrically opposite each other.

The end wall 62 of the projectile body 60 also has two recesses or detents 76 for receiving the indexing bosses 50 of the diverter ring 40. The detents 76 are diametrically opposite each other. The two detents 76 and the two passages 74, in the projectile body end wall 62, are located at ninety degree intervals around the axis 24.

To assemble the projectile 12, the nose 20 and the diverter ring 40 are bonded or otherwise secured to each other for rotation as one unit. The passages 30 in the nose 20 are aligned with and open into the passages 46 in the diverter ring 40, forming two vents 80 in the projectile 12. (The vents 80 may alternatively be considered to include, or be, only the passages 30 that are in the projectile nose 20.)

The assembly of the nose 20 and diverter ring 40 is then connected with the projectile body 60, with the seal 78 between them. The locking pin 48 on the diverter ring 40 is inserted into the locking pin opening 72 in the projectile body 60, and the barbs on the locking pin hold the pieces in place as shown in FIGS. 4 and 5.

The seal 78, which may be an O-ring for example, is located between the diverter ring 40 and the projectile body 60. The seal 78 leaves a small amount of axial play between the diverter ring 40 and the projectile body 60, which is used during the indexing process. The seal 78 also maintains a moisture seal for the projectile 12.

In this condition, the assembly of the diverter ring 40 and the projectile nose 20 is rotatable, or indexable, about the axis 24, relative to the projectile body 60. The presence of the indexing bosses 50 on the diverter ring 40 provides four index positions for the projectile 12.

Figure 5:
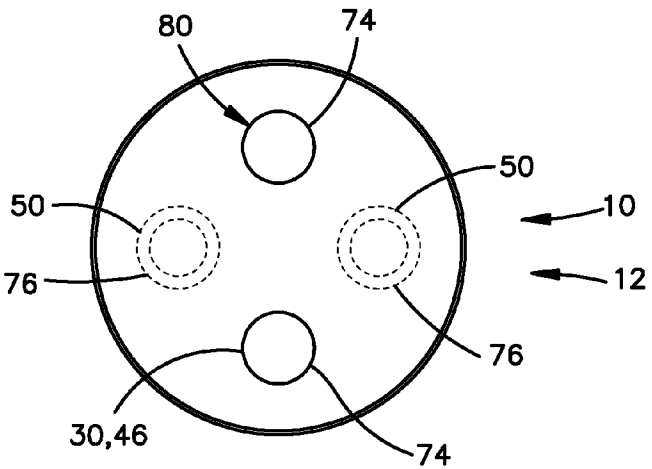
FIG. 5 is a schematic radial sectional view through the open vents of the projectile of FIG. 4.
Figure 7:
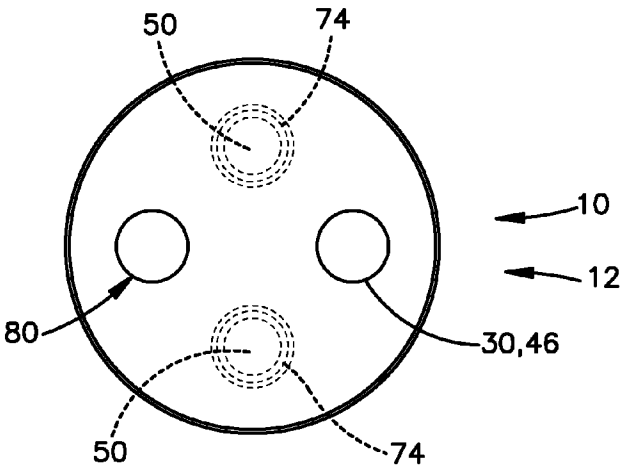
FIG. 7 is a schematic radial sectional view through the closed vents of the projectile of FIG. 6.
Figure 4:
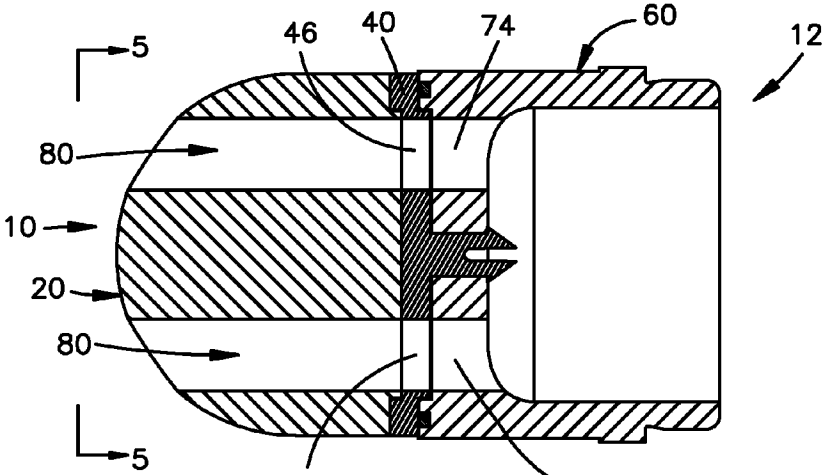
FIG. 4 is an enlarged longitudinal sectional view of the projectile of FIG. 1, showing the vents in an open condition.
Figure 6:
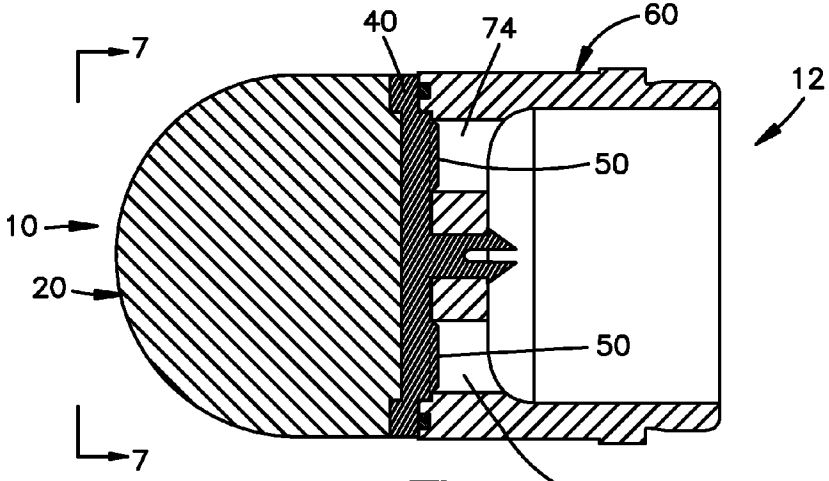
FIG. 6 is a view similar to FIG. 4 showing the vents in a closed condition.
Figure 9:
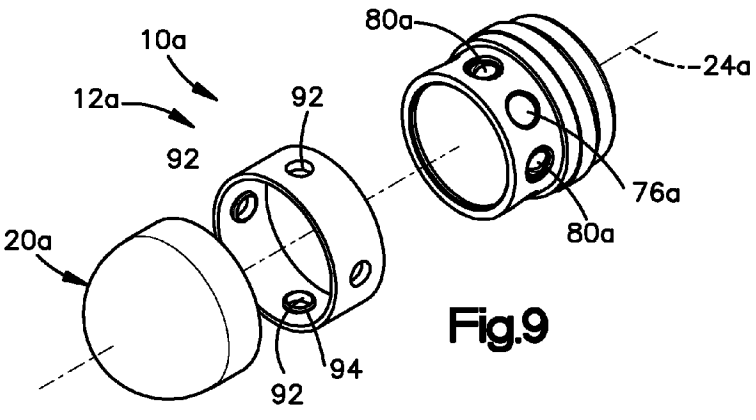
FIG. 9 is an exploded perspective view of the projectile of FIG. 8.
Figure 8:
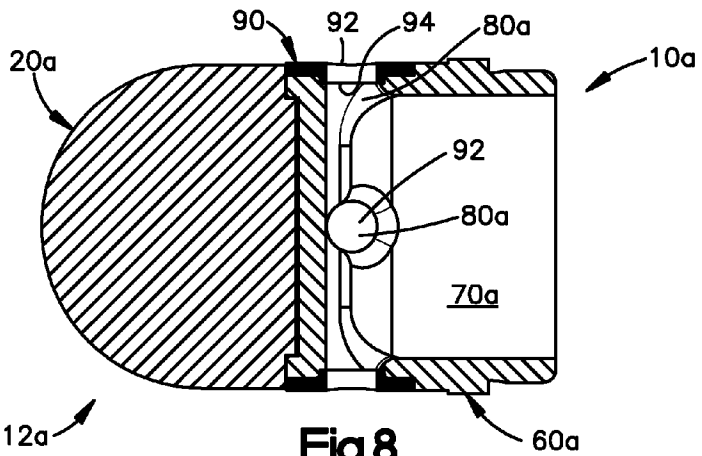
FIG. 8 is a longitudinal sectional view of a projectile forming part of a munition that is a second embodiment of the invention, with radial vents shown in an open condition.
Figure 11:
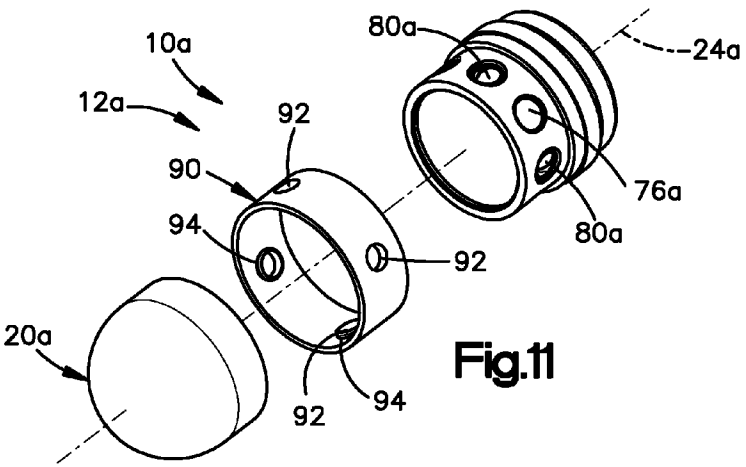
FIG. 11 is an exploded perspective view of the projectile of FIG. 10.
Figure 10:
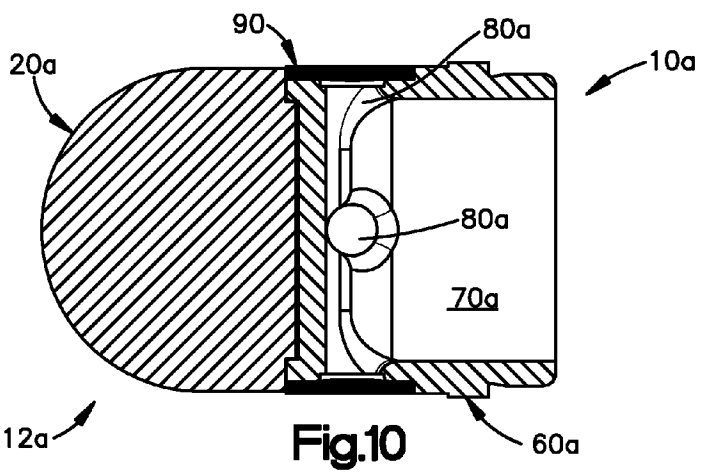
FIG. 10 is a view similar to FIG. 8 showing the vents in a closed condition.

Specifically, in two of these index positions, one of which is shown in FIGS. 4 and 5, the bosses 50 on the diverter ring 40 are located in the detents 76 of the projectile body 60. In these two index positions, the passages 46 in the diverter ring 40 are aligned with and open into the passages 74 in the end wall 62 of the projectile body 60. Thus, there is an open path for gas to flow from the pressure chamber 70 through the vents 80 in the projectile 12 to atmosphere.

In the other two index positions (FIGS. 6 and 7), which are 180 degrees opposite each other but 90 degrees from the first two index positions, the bosses 50 on the diverter ring 40 are located in the passages 74 of the projectile body 60. In these two index positions, the passages 46 in the diverter ring 40 are spaced apart angularly 90 degrees from the passages 74 in the end wall of the projectile body 60. Thus, the vents 80 are blocked, and there is no open path for gas to flow out of the pressure chamber 70 through the projectile nose 20.

The finished projectile 12 is inserted into a pre-loaded shell 16, readied for use. The shell 16 is loaded with a propellant load sufficient for long range applications.

If the cartridge 10 is to be used as a long range munition, the projectile nose 20 and diverter ring 40 are rotated to an index position (FIGS. 6 and 7) in which the vents 80 are not aligned with the passages 74 in the projectile body 60. In this position, the vents 80 are closed.

When the propellant unit 14 is thereafter discharged, gas under pressure fills the pressure chamber 70 in the projectile body 60. The force of the gas under pressure is applied against the rear side surface 66 of the projectile body 60, and also against the bosses 50 on the rear side surface 44 of the diverter ring 40. Because the vents 80 are closed, a relatively large amount of gas from the propellant unit 14 acts against the radially extending surface area of the projectile 12, and the projectile is released and expelled with maximum force.

If the cartridge 10 is to be used as a short range munition, the projectile nose 20 and diverter ring 40 are rotated to an index position (FIGS. 1, 4 and 5) in which the vents 80 are aligned with the passages 74 in the projectile body. In this position, the vents 80 are open.

When the propellant unit 14 is thereafter discharged, gas under pressure fills the pressure chamber 70 in the projectile body 60. The force of the gas under pressure is applied against the rear side surface 66 of the projectile body 60, but a significant portion of the gas flows axially out of the projectile 12 through the passages 74 in the projectile body and through the open vents 80. As a result, only a relatively small portion of the gas from the propellant unit 14 acts against the radially extending surface area of the projectile 12, and the projectile is released and expelled with lesser force. The controlled bleeding of the propellant gases reduces the force with which the projectile 12 is expelled. This can result in either (a) the projectile traveling a shorter distance (range), or (b) the projectile impacting the target with reduced force after traveling the same distance (range); or a combination of both.

FIGS. 8-11 illustrate a projectile 12*a* that is a second embodiment of the invention. In this embodiment, gas is selectively vented, or bled, radially rather than axially. Parts of the projectile 12*a* that are the same as or similar in construction to corresponding parts of the projectile 12 are given the same reference numerals with the suffix "a" added to distinguish them.

The projectile 12*a* includes a projectile body 60*a* having a plurality of vents 80*a*, in this case four vents, spaced circumferentially about the forward end of the body. The vents 80*a* extend radially through the side wall of the body 60*a* and are in fluid communication with the pressure chamber 70*a*. The body 60*a* also has a plurality (in this case four) of index pockets, or detents 76*a*, one pocket being disposed between each pair of adjacent vents 80*a*.

The projectile 12*a* also includes an adjusting sleeve 90. The adjusting sleeve 90 has a cylindrical configuration and is supported on the side wall of the projectile body 60*a* for rotation relative to the body about the axis 24*a*. The adjusting sleeve 90 has a plurality (in this case four) of vent openings 92, spaced circumferentially about the sleeve, that extend radially through the sleeve. On the inner surface of the sleeve 90, at each one of the vent openings 92, there is provided a radially inwardly projecting index boss 94.

The projectile nose 20*a* in the projectile 12*a* does not have vent openings. The projectile nose 20*a* and a seal help to capture the adjusting sleeve 90 while placing the assembly under linear tension.

When the projectile 12*a* is to be used as a long range munition (FIGS. 10 and 11), the adjusting sleeve 90 is oriented by rotating it about the body 60*a* so that the vents 80*a* in the projectile body and the vent openings 92 in the adjusting sleeve are not in alignment, that is, do not overlie each other. This misaligned condition is secured by the engagement of the index bosses 94 of the sleeve 90 in corresponding index pockets 76*a* in the projectile base body 60*a*. This positioning of the parts closes the vents 80*a*. When the propellant unit is actuated with the vents 80*a* thus closed, all the propellant gases engage the rear surface of the projectile body 60*a*, expelling the projectile 12*a* from the shell with maximum force.

When the projectile 12*a* is to be used as a close range munition (FIGS. 8 and 9), the adjusting sleeve 90 is oriented by rotating it about the body 60*a* so that the vents 80*a* in the projectile body and the vent openings 92 in the adjusting sleeve are in alignment, that is, overlie each other. This aligned condition is secured by the engagement of the index bosses 94 of the sleeve 90 in the vents 80*a* of the body. This positioning of the parts opens the vents 80*a*. When the propellant unit is actuated with the vents 80*a* thus opened, some of the propellant gases engage the rear surface of the projectile body 60*a*, but some of the gases are bled off through the vents, thus expelling the projectile 12*a* from the shell with reduced force.

Figure 12A:
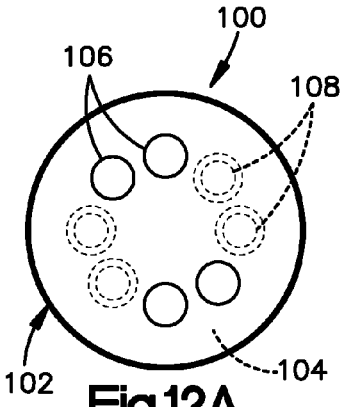
FIGS. 12A-12C are schematic illustrations of a projectile with vents that have a closed condition, a distinct partially open condition, and a distinct fully open condition.
Figure 12B:
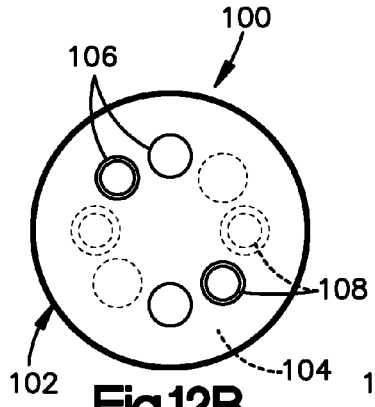
Figure 12C:
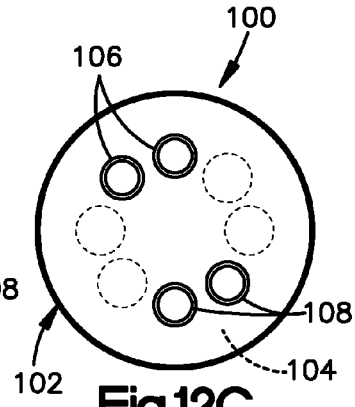

In each one of the first and second embodiments, described above, the vents are either fully open or fully closed. FIGS. 12A-12C illustrate an alternative configuration in which vents can be partially open, as well, to provide an intermediate level of venting (bleeding). In FIGS. 12A-12C, a vent closure for a projectile 12*b* is movable relative to a vent between a plurality of positions including a fully open position, a fully closed position, or any one of a number of partially open (partially closed) positions.

In this example, each one of two relatively rotatable members 102 and 104 has two pairs of adjacent openings 106 and 108, respectively. If the parts 102 and 104 are placed in the position of relative rotation shown in FIG. 12A, none of the openings 106 and 108 are aligned, and the vents are closed. If the parts 102 and 104 are placed in the position of relative rotation shown in FIG. 12B, some but not all the openings are aligned, and the vents are partially open. If the parts 102 and 104 are placed in the position of relative rotation shown in FIG. 12C, all the openings 106 and 108 are aligned, and the vents are fully open.

Figure 13A:
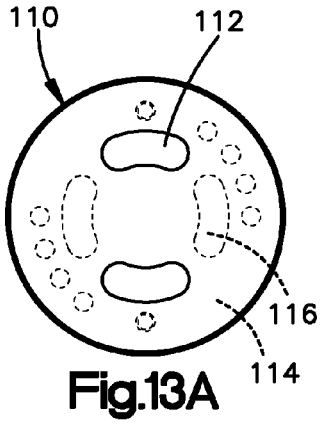
FIGS. 13A-13C are schematic illustrations of a projectile with vents that are movable from a closed condition through a plurality of partially open conditions to a fully open condition.
Figure 13B:
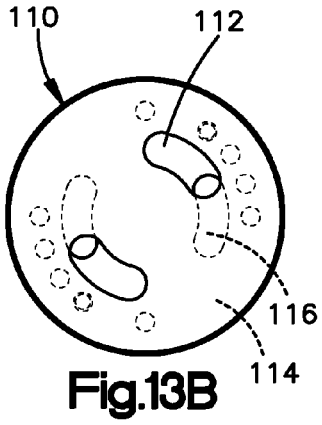
Figure 13C:
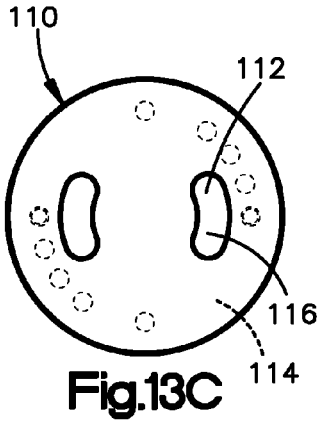

FIGS. 13A-13C illustrate the use of an "infinitely variable" rather than discrete closure mechanism for vents. In FIGS. 13A-13C, a first member 110 having a vent opening 112 is rotatable relative to a second member 114 having a vent opening 116, through a continuous range of positions including a fully closed position, a partially open position, and a fully open position.

Figure 14:
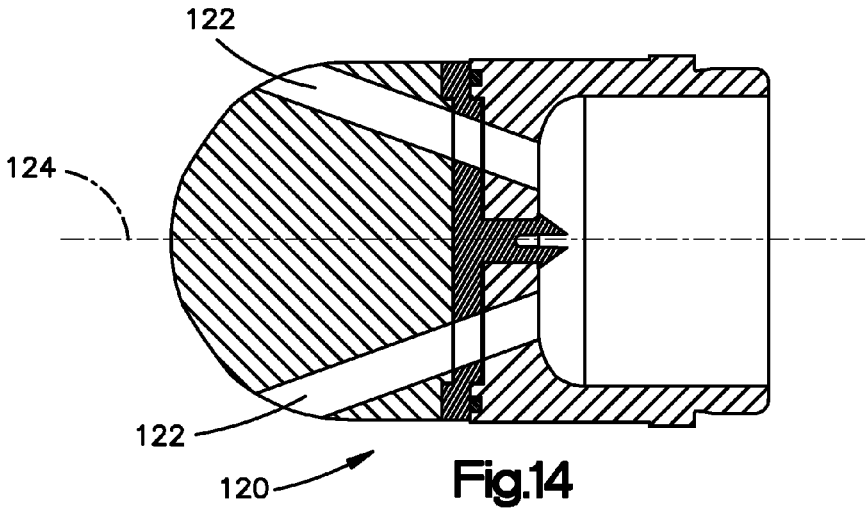
FIG. 14 is a longitudinal sectional view of a projectile having vents that extend neither axially nor radially.

FIG. 14 illustrates a projectile 120 having vents 122 that extend at an angle to the axis 124 that is greater than zero to one degrees (axial) as in FIGS. 1-7 but less than 89-90 degrees (radial) as in FIGS. 8-11. A suitable angle can be chosen on the basis of factors such as ease of manufacture, stability in flight, etc.

From the above description of the invention, those skilled in the art will perceive improvements, changes and modifications in the invention. For example, different numbers of vents can be used, from one to many; and vent configuration and location can be varied. The locking pin can be replaced with a screw and washer combination, or some other structure that will provide the two functions of securing the diverter ring to the projectile body while allowing for relative rotation between them. The projectile nose and the diverter ring can be formed as one piece, rather than as two separate pieces joined together. The vent can be configured with a closure that slides linearly over an opening, rather than rotating. Such improvements, changes and modifications within the skill of the art are intended to be covered by the appended claims.

The invention claimed is:

1. An adjustable range munition comprising:

a propellant section that is actuatable to produce gas under pressure; and a projectile releasably connected with the propellant unit;

the projectile having an engagement surface that receives force of the gas under pressure to cause the projectile to release from the propellant unit and travel toward a target;

the projectile having at least one gas vent that is selectively variable to affect the amount of force that is directed onto the projectile by the gas under pressure upon actuation of the propellant section.

2. A munition as set forth in claim 1 including a closure member on the projectile that moves to selectively vary the vent.

3. A munition as set forth in claim 2 wherein the closure member is a rotatable disc and the vent extends axially.

4. A munition as set forth in claim 3 wherein the vent extends axially through a nose of the projectile.

5. A munition as set forth in claim 2 wherein the closure member is a rotatable sleeve and the vent extends radially.

6. A munition as set forth in claim 5 wherein the sleeve is rotatable between a first position closing the vent and a second position fully opening the vent and at least one partially open position to provide an intermediate level of venting.

7. A munition as set forth in claim 5 wherein the sleeve is rotatable relative to the projectile body to selectively infinitely vary the vent.

8. A munition as set forth in claim 1 including a projectile body having the vent and a rotatable member that rotates relative to the projectile body to selectively vary the gas flow to the vent.

9. A munition as set forth in claim 1 including a projectile body and a closure member that moves relative to the projectile body to selectively infinitely vary the vent.

10. A munition as set forth in claim 1 wherein the vent extends at an angle to the axis that is between 1 degrees and 89 degrees.

11. A munition as set forth in claim 1 including a projectile body and a movable member that is movable relative to the projectile body between a first position closing the vent and a second position opening the vent, to selectively vary the vent, and including at least one detent to maintain the movable member in the selected position relative to the projectile body.

12. An adjustable range munition comprising:

a propellant section that is actuatable to produce gas under pressure; and a projectile releasably connected with the propellant unit;

the projectile having an engagement surface that receives force of the gas under pressure to cause the projectile to release from the propellant unit and travel toward a target;

the munition having means for affecting the amount of force that is directed onto the projectile by the gas under pressure upon actuation of the propellant unit;

wherein the means for affecting includes a movable member that is movable between a first position closing a vent and a second position opening the vent to selectively vary the vent; and wherein the movable member is rotatable on a body of the projectile.

13. A munition as set forth in claim 12 wherein the movable member is a rotatable sleeve and the vent extends radially.

14. An adjustable range munition comprising:

a propellant-unit that is actuatable to produce gas under pressure; and a projectile releasably connected with the propellant unit;

the projectile having an engagement surface that receives force of the gas under pressure to cause the projectile to release from the propellant unit and travel toward a target;

the projectile having at least one gas vent that is selectively variable to affect the amount of force that is directed onto the projectile engagement surface by the gas under pressure upon actuation of the propellant unit;

a closure member on the projectile that moves to selectively vary the vent; and at least one detent to maintain the movable member in the selected position.

15. A munition as set forth in claim 14 wherein the closure member is rotatable about a longitudinal central axis of the projectile.

16. A munition as set forth in claim 15 wherein the movable member is a rotatable sleeve and the vent extends radially.

* * * * *